US008876370B1

(12) United States Patent
Pampe

(10) Patent No.: US 8,876,370 B1
(45) Date of Patent: Nov. 4, 2014

(54) PENDULUM-REGULATED CLOCK

(71) Applicant: Mark E. Pampe, Lake Tapps, WA (US)

(72) Inventor: Mark E. Pampe, Lake Tapps, WA (US)

( * ) Notice: Subject to any disclaimer, the term of this patent is extended or adjusted under 35 U.S.C. 154(b) by 0 days.

(21) Appl. No.: 14/201,135

(22) Filed: Mar. 7, 2014

Related U.S. Application Data

(60) Provisional application No. 61/774,149, filed on Mar. 7, 2013.

(51) Int. Cl.
*G04B 17/02* (2006.01)

(52) U.S. Cl.
CPC ..... *G04B 17/02* (2013.01)
USPC ..... 368/134; 368/165; 368/179

(58) Field of Classification Search
USPC ..... 368/134–138, 165–167, 179–183
See application file for complete search history.

(56) References Cited

U.S. PATENT DOCUMENTS

| | | | | | |
|---|---|---|---|---|---|
| 120,185 | A | * | 10/1871 | Davis | 368/166 |
| 373,727 | A | * | 11/1887 | Deuss | 368/134 |
| 449,016 | A | * | 3/1891 | Wakeman | 368/137 |
| 550,959 | A | * | 12/1895 | Franklin | 368/166 |
| 551,234 | A | * | 12/1895 | Richey | 368/138 |
| 737,587 | A | | 9/1903 | Daily | |
| 965,507 | A | * | 7/1910 | Ecaubert | 368/182 |
| 1,182,838 | A | | 5/1916 | Cummings | |
| 3,411,288 | A | | 11/1968 | Koplar et al. | |
| 3,986,336 | A | | 10/1976 | Heim | |
| 4,043,118 | A | | 8/1977 | Haag et al. | |
| 4,115,996 | A | | 9/1978 | Coy | |
| 4,127,986 | A | | 12/1978 | Nozawa et al. | |
| 4,228,533 | A | | 10/1980 | Siefert | |
| 4,449,831 | A | | 5/1984 | Itami et al. | |
| 4,613,236 | A | | 9/1986 | Nakamura | |
| 4,666,312 | A | | 5/1987 | Mukoyama | |
| 4,791,621 | A | | 12/1988 | Wild et al. | |
| 5,268,881 | A | | 12/1993 | Damm | |
| 2004/0017734 | A1 | | 1/2004 | Stallinga | |
| 2009/0147335 | A1 | | 6/2009 | Schumm, Jr. | |
| 2010/0128573 | A1 | | 5/2010 | Meijer et al. | |

FOREIGN PATENT DOCUMENTS

WO WO 2007/049019 * 5/2007

OTHER PUBLICATIONS

Christiaan Huygens and Contact Geometry, Hansjorg Geiges, Mathematisches Institut Universitat zu Koln, NAW 5/6 nr. Jun. 2, 2005 (pp. 117-123).

A Royal 'Haagseklok', "Severyn Oosterwijck Haghe met privilege", Reviewed by Keith Pigott. Appendix Three, An 'Open Research Project. 2009 (5 pages).

* cited by examiner

*Primary Examiner* — Sean Kayes
(74) *Attorney, Agent, or Firm* — R. Reams Goodloe, Jr.

(57) ABSTRACT

A pendulum-regulated clock. The clock has a movement at the bottom of a multi-rod pendulum. In an embodiment, a first pendulum rod and a second pendulum rod are provided. The clock provides swinging motion by imparting an oscillating torque to one or more of the pendulum rods. In an embodiment, a dual escapement mechanism may be provided. A dual escapement mechanism may synchronize the dual escapements via differential adjustment, to uniformly power pendulum rods during both directions of swing.

12 Claims, 9 Drawing Sheets

© Mark Pampe, 2013, 2014

© Mark Pampe, 2013, 2014

© Mark Pampe, 2013, 2014

© Mark Pampe, 2013, 2014

© Mark Pampe, 2013, 2014

© Mark Pampe, 2013, 2014

© Mark Pampe, 2013, 2014

© Mark Pampe, 2013, 2014

© by Mark Pampe, 2012, 2013

© by Mark Pampe, 2012, 2013

PENDULUM-REGULATED CLOCK

RELATED PATENT APPLICATIONS

This application claims priority from prior U.S. Provisional Patent Application Ser. No. 61/774,149, filed Mar. 7, 2013, entitled PENDULUM-REGULATED CLOCK, the disclosure of which is incorporated herein in its entirety, including the specification, drawing, and claims, by this reference.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This application relates to clocks, and more particularly, to clocks using a pendulum, and which are driven by power transmission through one or more escapements.

BACKGROUND

Pendulum-regulated clocks have been in use for hundreds of years. Such devices were first patented in 1657 by Dutch scientist Christiaan Huygens. While many such devices were, or are, driven by weights, later devices may be powered by springs, or by electric motors, or by other power sources.

The vast majority of prior art pendulum-regulated clocks utilize a basic design configuration having a fixed (as in mounted on a wall or within a cabinet) movement from which hangs the regulating pendulum. The movement powers the pendulum via an escapement, and is in turn regulated by the period of the pendulum swing. Note that in the present specification, the term "movement" or "clock movement" will normally be used as the noun for operative components including mechanical gears, shafts, escapement, hands, and the like. Thus, the term "motion" may be used when a verb is proper in the usual context.

Some exceptions to the basic design configuration just illustrated do exist, such as so called "swinger clocks" wherein the clock movement is mounted on the upper portion of a single, rigid compound pendulum. Such prior art clocks, however, utilized a different manner of operation than that described herein. In a "swinger clock", this compound pendulum serves as the regulating pendulum, the period of which is commonly adjusted by raising or lowering a weight, or bob, attached to the lower portion of the compound pendulum. A second "slave" pendulum is mounted within the movement, is powered by the movement, and provides the impulse energy to cause the compound pendulum to swing.

In 1986, in U.S. Pat. No. 4,600,315, entitled "Whole Body Swingable Clock", Nakamura described a "swinger clock". Nakamura addressed some of the existing problems in the art by making his clock easier to wind, to start, and to adjust when compared to some prior art "swinger clock's". However, he did not alter the basic architecture of such clocks, and used an existing design configuration which utilized a clock movement atop a single, rigid compound pendulum that derives its motive impulse from a second pendulum within the clock movement.

The invention of this present specification is a clock configuration substantially and essentially different from the "swinger clock", as this invention does not use a rigid compound pendulum and requires no second pendulum within the clock movement.

Another basic configuration of a pendulum-regulated timekeeping device is the common metronome, as patented by Johann Maelzel in 1816. The metronome is essentially the usual design of a rigid pendulum hanging from the movement that powers it, except that the rigid pendulum is a compound pendulum. As such, a moveable weight on the top portion of the compound pendulum affords easy adjustment of the desired beat.

In the art of building unusual clocks, the use of a pendulum-regulated movement appears to have been limited to configurations such as a pendulum hanging from the movement, or the "swing clock" as described above, or a common metronome. Consequently, provision of a unique configuration for a pendulum-regulated clock is believed to be an interesting and significant contribution to the art.

BRIEF DESCRIPTION OF THE DRAWING

Various aspects of the developments described herein will be described by way of exemplary embodiments, illustrated in the accompanying drawing figures in which like reference numerals denote like elements, and in which.

Figure 1A:
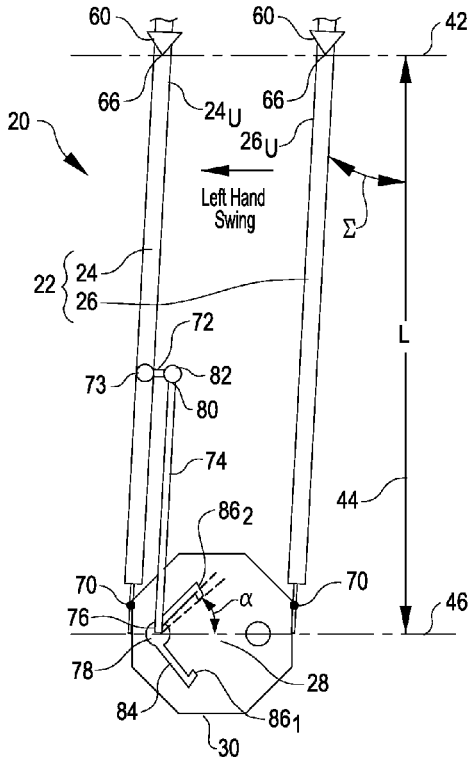
FIG. 1A illustrates an embodiment for a pendulum-regulated clock, with two, parallel pendulum rods, and a clock movement suspended therefrom.

In the various figures of the drawing, like features may be illustrated with the same reference numerals, without further mention thereof. Further, the foregoing figures are merely exemplary, and may contain various elements that might be present or omitted from actual implementations of various embodiments depending upon the circumstances. An attempt has been made to draw the figures in a way that illustrates at least those elements that are significant for an understanding of the various embodiments and aspects of the developments described herein. However, various other elements for a pendulum-driven clock, especially as applied for different variations of the functional components illustrated, as well as different embodiments of artistic elements such as a shape of components or visual design of various elements, may be utilized in order to provide a useful, reliable, visually attractive and intellectually intriguing timepiece.

SUMMARY

A prototype of the pendulum-regulated clock has been developed and is operational. The clock has a movement at the bottom of a multi-rod pendulum. In an embodiment, a first pendulum rod and a second pendulum rod are provided. In an embodiment, the clock swings itself by imparting an oscillating torque each of two pendulum rods.

In an embodiment, a dual escapement mechanism is provided such that one escapement mechanism is paired with each pendulum rod. The dual escapement mechanisms are synchronized via a differential adjustment, to uniformly power both pendulum rods during both directions of swing.

In an embodiment, a counter-rotating escapement is provided. In such embodiment, two relatively smaller meshed wheels are used in place of a traditional single relatively larger wheel.

More generally, a pendulum-regulated clock is provided. The pendulum-regulated clock is driven by one or more escapements of common or counter-rotating design. In such embodiments, a clock movement may be provided that is, or is within, the pendulum bob. In an embodiment, the pendulum bob, and thus the clock movement, remains horizontal during clock operation. The entire clock swings, as a pendulum, from attachment points on a wall, ceiling, or other structure.

A traditional pendulum-regulated mechanical clock uses the relative angular motion between a pendulum and a clock movement to regulate temporal operation of the clock via an escapement. The clock movement is commonly firmly affixed to a wall or cabinet, and the pendulum bob is commonly suspended from the clock movement by a single rod. In more elaborate pendulums, multiple rods of different materials are used such that the length of the pendulum is less affected by temperature changes. In these cases, the multiple rods are structurally joined such that they act as one rigid pendulum rod.

In contrast, in the pendulum-regulated clock described herein, the clock movement and the pendulum bob are one in the same, and therefore, if the pendulum bob were affixed to a single pendulum rod, no relative motion between the two would exist. Thus, an alternate configuration is necessary to provide the relative angular motion needed for temporal regulation. In an embodiment, the needed relative angular motion is achieved by suspending the clock movement from two parallel rods. As the clock movement swings suspended from these two parallel rods, simple geometry (i.e., a parallelogram of changing shape is provided) keeps the clock movement in a horizontal orientation. This induces a relative angular motion between the clock movement and the pendulum rods from which the movement is suspended. This relative angular motion is then used, via an escapement (or, in the case of an embodiment of the invention, two escapements), to regulate temporal operation of the clock (see FIGS. 1A and 1B).

Figure 10:
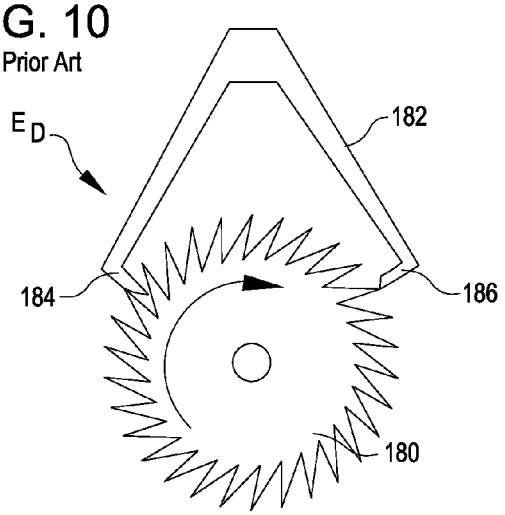
FIG. 10 Prior Art
FIG. 10 is a front view of an embodiment for a common deadbeat escapement, showing the escapement wheel, verge, and including the entry pallet and the exit pallet.

Many prior art pendulum-regulated clocks use a common deadbeat escapement, like the device illustrated in FIG. 10. While a common deadbeat escapement could be used in an embodiment of a pendulum-regulated clock as disclosed herein, instead, in an embodiment as described herein, a counter-rotating escapement may be provided (see FIG. 7).

In an embodiment, because a pendulum-regulated clock described herein uses two pendulum rods, there are two sources available for relative angular motion for use in clock temporal regulation. Such sources occur between the clock movement and each of the pendulum rods. In an embodiment described herein, dual escapements are utilized. Such an embodiment cuts in half the force transferred through each escapement, as compared to the use of a single escapement, comparatively reducing wear on each of dual escapements. Such an embodiment also promotes isochronous behavior, in that the clock swing is powered symmetrically. A differential mechanism is used to ensure equal force is transmitted through each escapement (see FIG. 6, reference number 150, FIG. 8, and FIG. 9).

The foregoing briefly describes a pendulum-regulated clock. The various objectives, features and advantages of the devices described herein will be more readily understood upon consideration of the following detailed description, taken in conjunction with careful examination of the accompanying figures of the drawing. However, as with any mechanical clock, the purpose of building such devices in the current electronic age is largely aesthetic. Such a clock may serve the purpose of keeping time. However, such mechanical clocks, and specifically the pendulum-regulated clock described herein, serve the additional purpose of keeping time in an artfully novel, mechanically intriguing, and aesthetic pleasing way.

DETAILED DESCRIPTION

Figure 11:
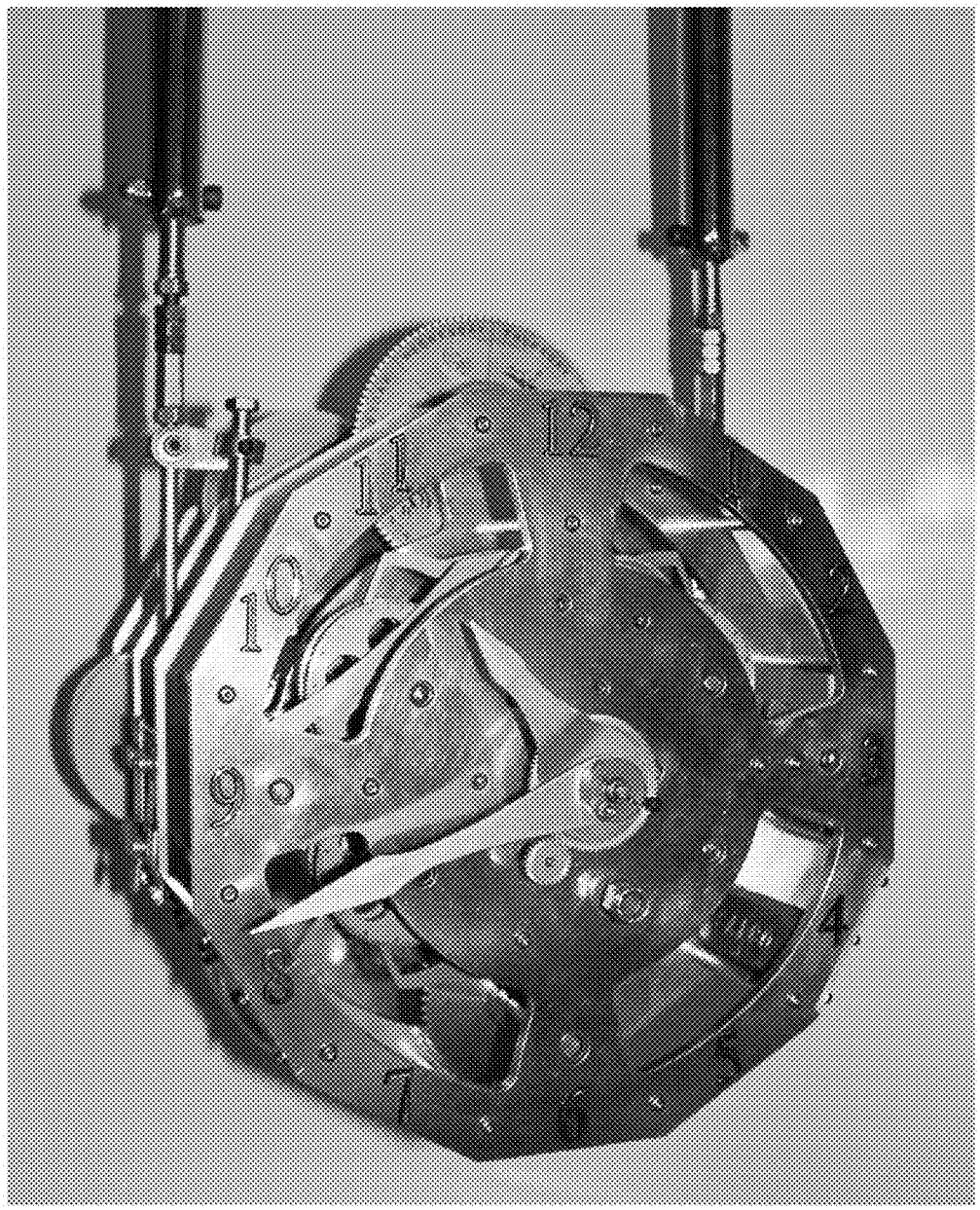
FIG. 11 is photograph that provides a partial perspective view of a prototype for a pendulum-regulated clock, built as set forth hereinbelow.
Figure 12:
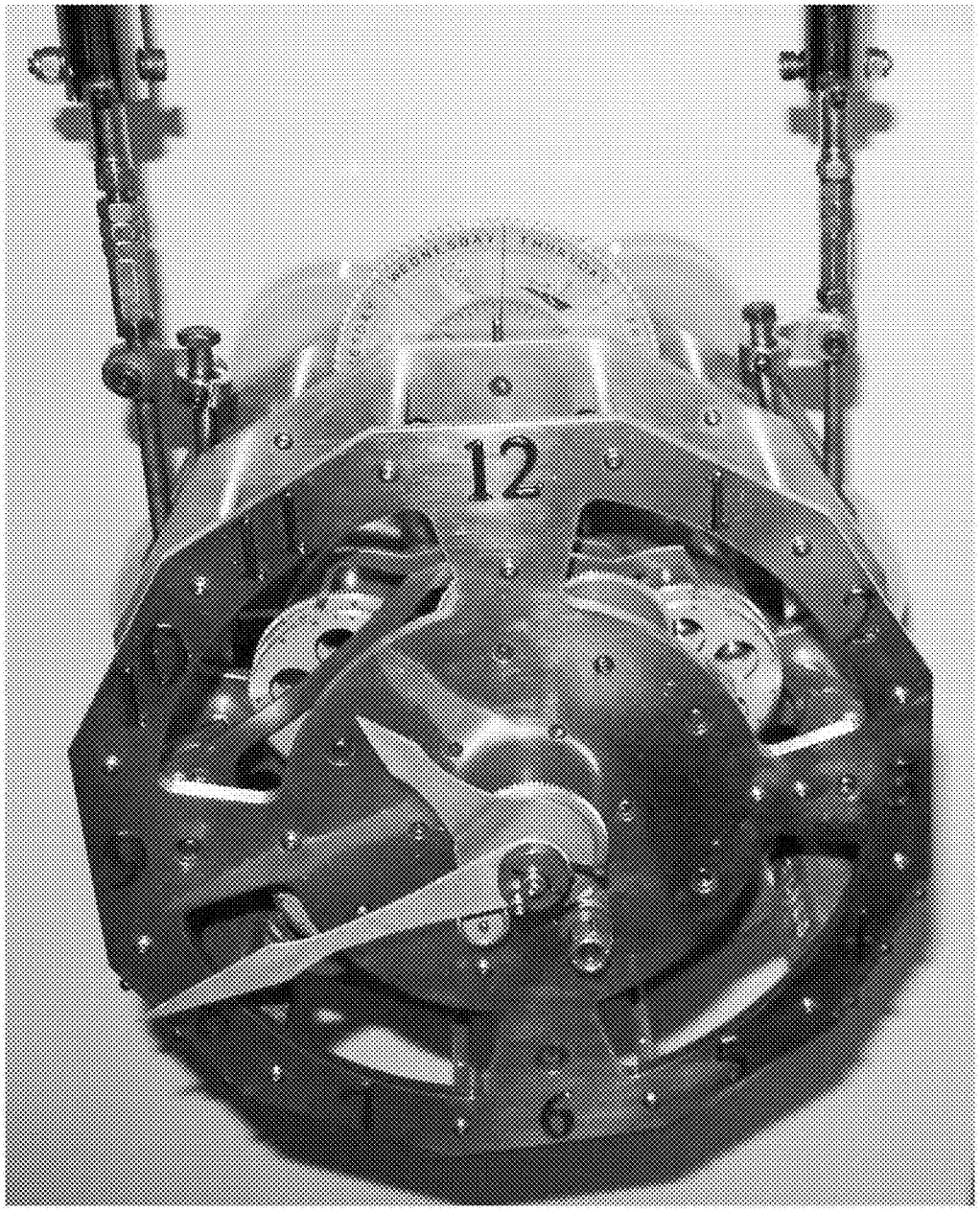
FIG. 12 is photograph that provides a partial perspective view of a prototype for a pendulum-regulated clock, built as set forth hereinbelow, taken looking down on the clock movement, and also revealing the connections between the clock movement and the first pendulum rod and the second pendulum rod.

Attention is directed to FIGS. 11 and 12, where a prototype embodiment for a pendulum-regulated clock 20 is depicted. Such prototype clock 20 has been constructed and operated successfully. It should be noted that other embodiments of a clock may be constructed using the designs taught herein, or portions thereof.

Figure 1B:
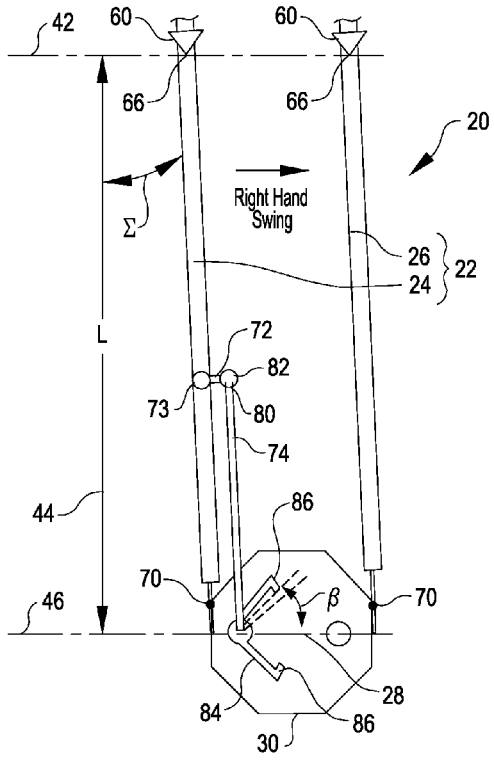
FIG. 1B illustrates an embodiment for a pendulum-regulated clock similar to the illustration just set forth in FIG. 1A, showing two, parallel pendulum rods, and a clock movement suspended from the parallel pendulum rods, and which, conjunction with FIG. 1A, illustrates the relative angular motion utilized, via the escapement, for temporal regulation of the clock.

A conceptual configuration is shown in FIGS. 1A and 1B for an embodiment for a pendulum-regulated clock 20. A pendulum-regulated clock 20 may use a two-rod pendulum 22 that includes a first pendulum rod 24 and a second pendulum rod 26. A clock movement 28 (notational, detail not shown in FIGS. 1A and 1B) may be provided as a part of, or within, a pendulum bob 30. A clock movement 28 associated with pendulum bob 30 may include one or more common escapements. As more fully depicted in FIG. 6 which is further discussed below, a clock movement 28 associated with pendulum bob 30 may include two escapements, $E_1$ and $E_2$, where $E_1$ comprises meshed, counter-rotating escapement wheels 152 and 154 along with verge arms 84, and where $E_2$ comprises meshed, counter-rotating escapement wheels 32 and 34 along with verge arms 85. A first escapement $E_1$ is paired to a first pendulum rod 24 and a second escapement $E_2$ is paired to a second pendulum rod 26. A differential adjustment (see reference 150 in FIG. 6 as further discussed below) is normally provided as necessary to maintain synchronous operation of each escapement. Particulars of escapements $E_1$ and $E_2$ will be discussed below in more detail, especially in discussion relating to FIG. 6. Also, to simplify certain figures of the drawing for explanatory purposes, FIGS. 1A and 1B only illustrate one escapement mechanism, $E_1$. However, it should be understood that a second escapement $E_2$ and its accompanying components, not shown in FIGS. 1A and 1B, will be present in a clock 20, as will be easily understood by those of skill in the art. An individual escapement, $E_2$, is more clearly seen in isolation in FIG. 7.

In an embodiment, a two-rod pendulum 22 may be used, with the clock movement 28 within the pendulum bob 30. Relative oscillating motion with a predictable frequency is used to control temporal operation of the clock 20. Such motion is generated by the swinging motion of pendulum rods 22 and is communicated to the gear train 94 of clock movement 28 via an escapement mechanism.

As seen in FIGS. 1A and 1B, in an embodiment of the clock 20, suspending the clock movement 28 in or as part of pendulum bob 30 from first 24 and second 26 pendulum rods, which may be in a near-parallel configuration, creates a geometry such that the clock movement 28 remains near-horizontal during swinging movement. In an embodiment, clock movement 28 may remain precisely horizontal during swinging movement of clock 20. This normally occurs, assuming a horizontal mounting fixture noted as an upper horizontal reference line 42, regardless of swing angle sigma ($\Sigma$) of first pendulum rod 24 and second pendulum rod 26. This configuration creates the needed predictable oscillating motion where the first 24 and second 26 pendulum rods join the pendulum bob 30 containing clock movement 28. This oscillating motion may be observed by comparing FIGS. 1A and 1B, wherein the relative angle between the clock movement 28 and the escapement verge 84 is alpha ($\alpha$) when the clock is swung to the left as seen on FIG. 1A, and comparatively the relative angle between the clock movement 28 and the escapement verge 84 is beta ($\beta$) when the clock is swung to the right as seen on FIG. 1B.

In an embodiment, first 24 and second 26 pendulum rods are provided. In a prototype embodiment, a pendulum rod length L (shown along a vertical reference line 44 extending between the upper horizontal reference line 42 and a lower horizontal reference line 46) was adjusted to approximately eighty eight (88) inches. In that configuration, the pendulum rod length L provided a pendulum period (T) of three (3) seconds. [Note that this can be seen from the formula that describes the physics: T≈2*(PI^2)*((L/g)^0.5)]. A gear train 94 for clock movement 28 can be designed to accommodate a selected pendulum length L and associated pendulum period T.

The period T of the pendulum swing may be adjusted in a number of different ways, depending on the construction utilized in an embodiment for a clock 20. In an embodiment, a weight W (not shown) may be attached to a pendulum bob 30, affixed such that it may be adjusted up or down relative to the pendulum bob 30. A weight W so adjusted in turn adjusts the period T of the pendulum swing. Alternately, in an embodiment, the length L of the first 24 and second 26 pendulum rods can be adjusted, via a turnbuckle (see FIGS. 11 and 12) or similar device, which in turn adjusts the period T of the pendulum swing. Alternately, in an embodiment as seen in FIG. 2, first 24 and second 26 pendulum rods may be each hung from an upper mounting spreader bar 50 that is in turn supported by first 54 and second 56 support pins, and in such case each spreader bar 50 may be adjusted from its initial position at an initial spreader bar height H (at distance D above upper horizontal line 42), either upward from or downward toward upper horizontal line 42, to a height H' at distance D' above upper horizontal line 42) to change an effective length from L to L' of the first 24 and second 26 pendulum rods.

Figure 2:
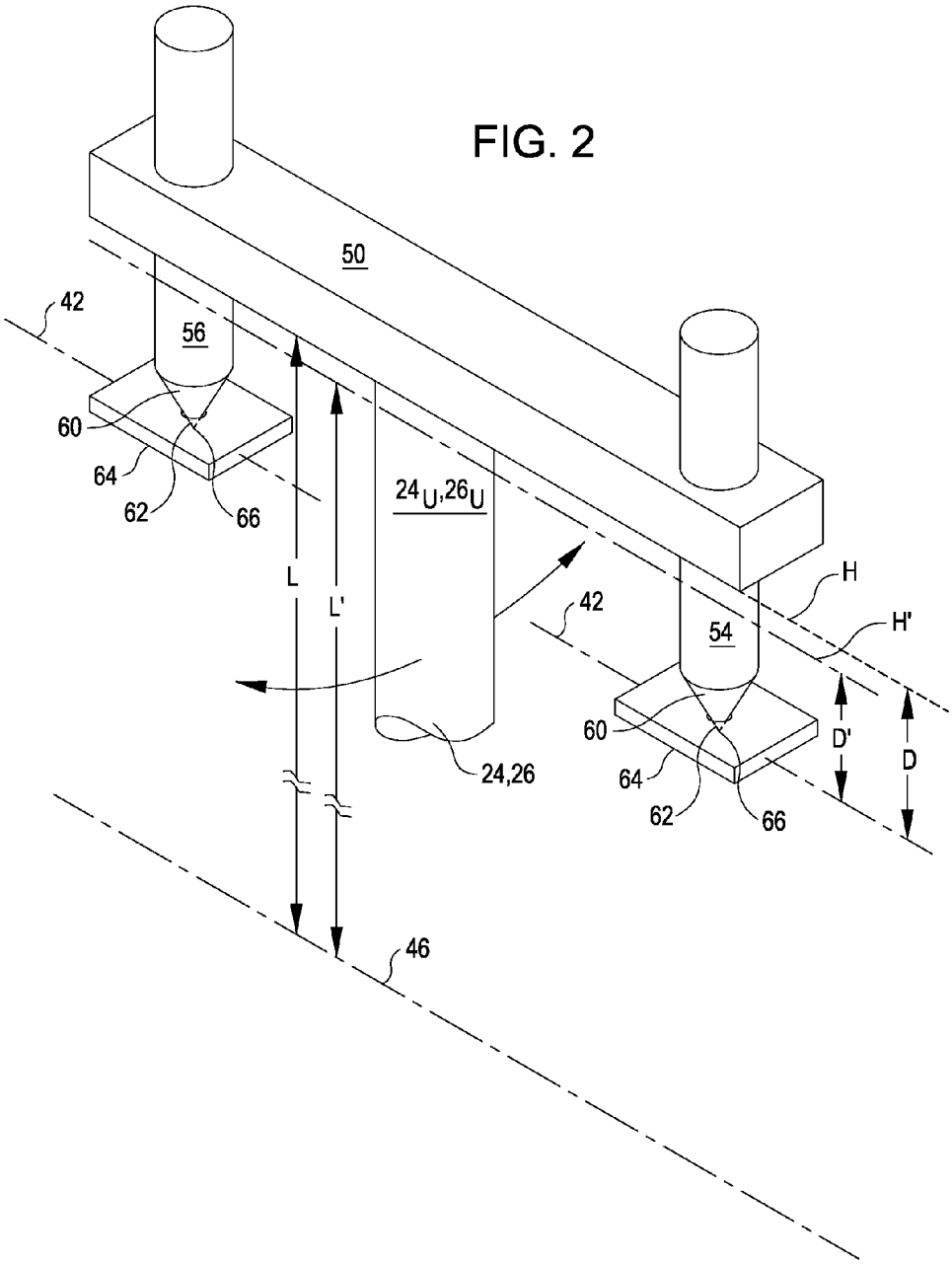
FIG. 2 illustrates an embodiment for support of a pendulum-regulated clock, showing support rails having divots therein for placement of support pins, and use of a spreader bar from which a pendulum rod is suspended.

As additionally seen in FIG. 2, in an embodiment, a pair of support pins 54 and 56 may be provided for each of pendulum rods 24 and 26, and a spreader bar 50 may be provided to join the pair of support pins 54 and 56 in an operative configuration, wherein the first 24 or second 26 pendulum rod is hung from its respective spreader bar 50 as just noted above. In an embodiment, each of support pins 54 and 56 may have a support pin edge portion 60 which may be located at a divot 62 in a support rail 64. Support rail 64 should normally be firmly attached to a wall or other structure. Such a configuration is normally considered a low-friction pin-style bearing configuration. For example, each of support pin edge portions 60 may include a pivot point 66 (as seen in FIG. 2) to minimize contact with a surface in the divot 62. Other embodiments may use other attachment methods for attachment of upper pendulum rod $\mathbf{24}_U$ of first pendulum rod 24, and upper pendulum rod $\mathbf{26}_U$ of second pendulum rod 26, and provide a clock 20 in accord with the teachings herein.

In an embodiment, as shown in FIG. 1A a pendulum rod (e.g., first 24 pendulum rod) may be attached to a clock movement 28 in pendulum bob 30 via a ribbon 70 of spring steel. Second pendulum rod 26 may be similarly attached. As shown in FIG. 1A, a swing rod link 72 is pivotally attached at first end 73 to first pendulum rod 24. A swing rod 74 is fixedly attached at lower end 76 to verge pivot 78, and pivotally attached at upper end 80 to a second end 82 of swing rod link 72. As the clock 20 swings, translational motion between a verge 84 and a pair of meshed escapement wheels 152 and 154 communicates angular motion from the first pendulum rod 24 to clock movement 28 via the verge 84, swing rod 74 and swing rod link 72. In an embodiment, a mirror-image of this interaction also occurs for the second pendulum rod 26, via a similar swing rod link and swing rod, a second verge 85, and a second set of escapement wheels 32 and 34 (see references 85, 32 and 34 in FIG. 7).

Clock Movement 28 Construction.

Figure 3:
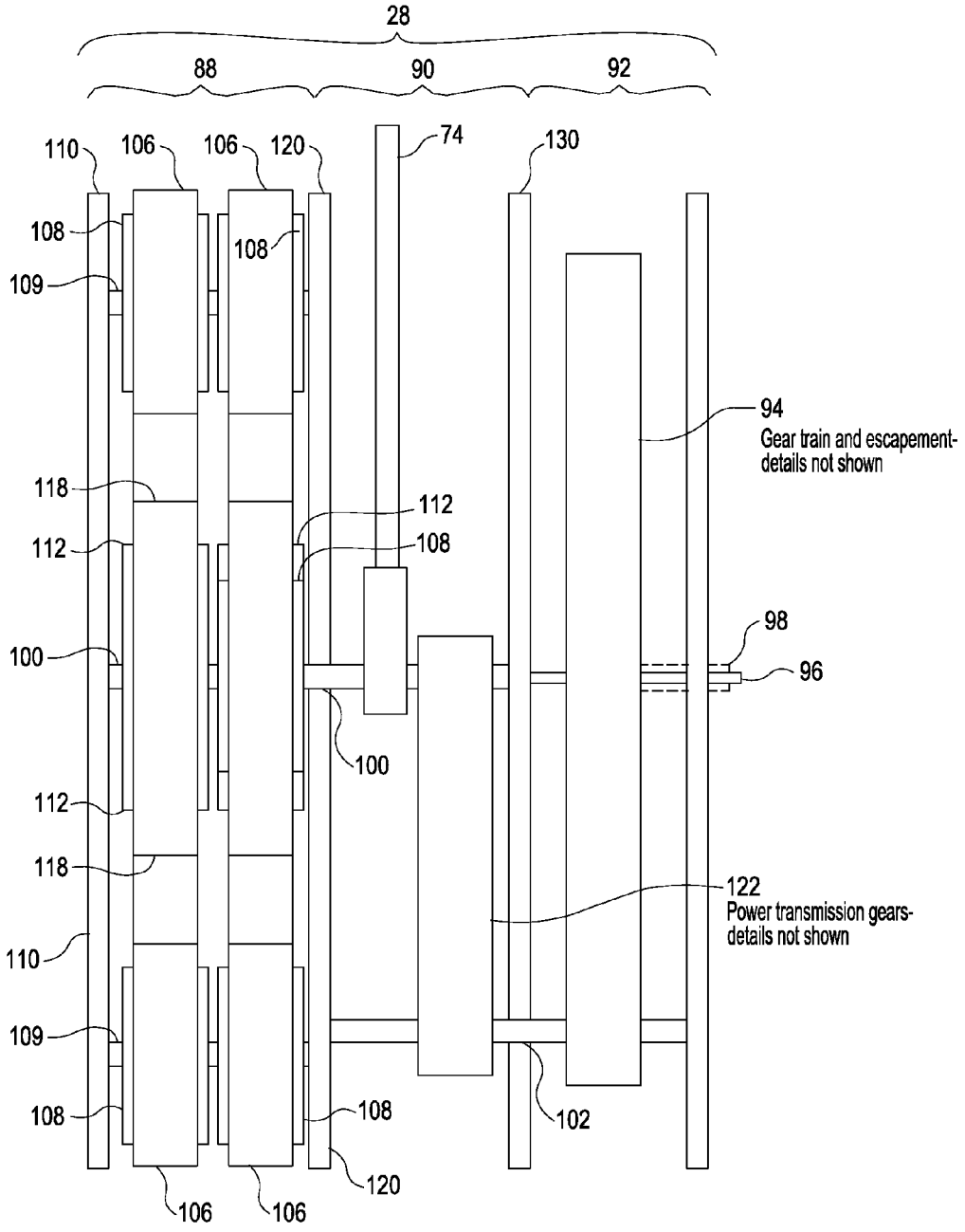
FIG. 3 is a side-view illustrating the arrangement of the inner workings for an embodiment of a pendulum-regulated clock, showing a spring motor layer, a suspension layer, a regulation layer, a power shaft from the spring motor layer to the suspension layer, a power shaft from the suspension layer to the regulation layer, and spring motor output spools.

In an embodiment, a clock movement 28 may be constructed in three layers, as depicted in FIG. 3. The three layers include:

(a) a Spring Motor Layer 88, where motive energy is stored to operate the clock 20;

(b) a Suspension Layer 90, where the movement is attached to the pendulum rods (e.g., to first pendulum rod 24 and to swing rod 74); and (c) a Regulation Layer 92, where the remainder of the gear train 94 and one or more escapement mechanisms are mounted. A minute hand (not shown in FIG. 3, see FIG. 11) may be mounted to shaft 96 protruding forward from this Regulation Layer 92. An hour hand (not shown in FIG. 3, see FIG. 11) may be mounted using another shaft 98 (shown in hidden lines) which may be concentric with shaft 96

Shafts and torque-reduction gears transfer the power from the Spring Motor Layer 88 to the Suspension Layer 90 via a suspension power shaft 100. Power is further transferred to the Regulation Layer 92 via power transmission gears 122 and a regulation power shaft 102.

Spring Motor Layer 88.

Figure 4:
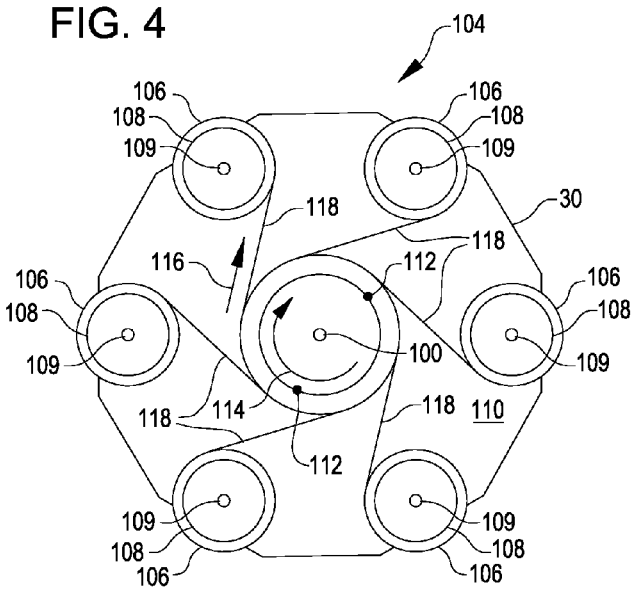
FIG. 4 provides details for an embodiment for a spring motor for a pendulum-regulated clock, showing use of a constant torque spring material ribbon, a spring material storage spool, a spring motor output spool, and a structural mounting plate.

In an embodiment, power for a clock movement 28 gear train 94 begins with a spring motor 104 in spring motor layer 88. As seen in FIG. 4, in an embodiment, a spring motor 104 may be provided utilizing multiple constant torque springs 106, having storage spools 108 on shafts 109 which may mounted to structural mounting plate 110. A plurality of constant torque springs 106 and accompanying storage spools 108 may be ganged with a plurality (e.g., two) of spring motor output spools 112. The spring motor output spools 112 in turn drive a suspension power shaft 100. The spring motor output spools 112 may be configured to turn in the direction shown by curved reference arrow 114 in FIG. 4 in response to spring force shown by reference arrow 116 along a ribbon 118 of spring material. Thus, the torque on spring motor output spool 112 is in the direction shown by reference arrow 114. Each spring 106 is provided by a ribbon 118 of spring material that is sized and shaped and has strength and tension properties which provide a design wherein the ribbon 118 of spring material tends to wrap itself around a storage spool 108. The force generated along ribbons 118 in the direction of reference arrow 116 translates into a torque around the output spool 112 in the direction of reference arrow 114 in FIG. 4. The entire spring motor layer 88 is mounted between two structural mounting plates; plate 110 and plate 120 (see FIG. 3 in the latter case). Power developed is available at the suspension power shaft 100 until all of the spring material in ribbons 118 is transferred onto the spring storage spools 108. To wind the clock 20, an opposite (in the depicted embodiment, counter-clockwise) torque is manually applied to the suspension power shaft 100 until the spring material provided by ribbons 118 is once again wound around the output spool(s) 112. Those of skill in the art will recognize, and will be able to construct clock 20 without additional instruction, that a ratchet (not shown) should be provided somewhere between the spring motor layer 88 and an escapement so that the spring ribbons 118 can be wound without engaging the escapements. In an embodiment, such a ratchet may be provided in the Regulation Layer 92.

Suspension Layer 90.

Figure 5:
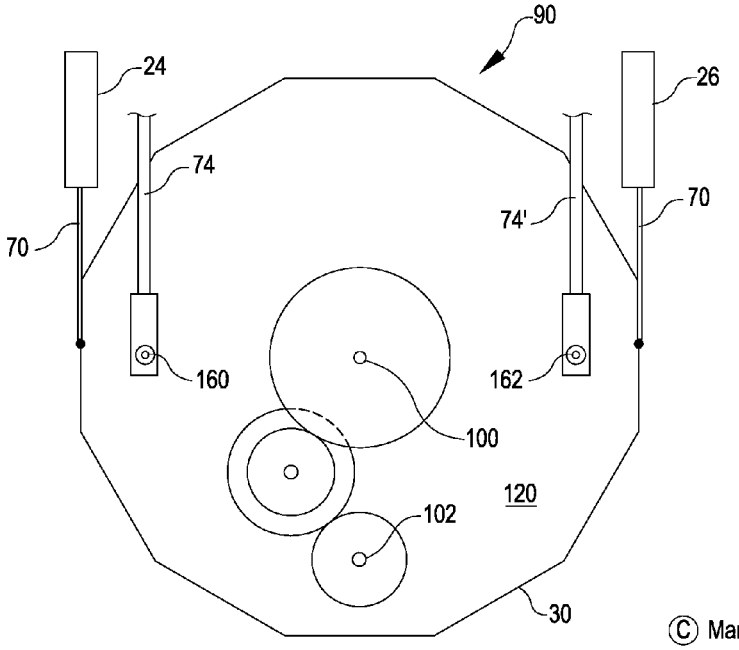
FIG. 5 provides details for an embodiment for a suspension layer in a pendulum-regulated clock, showing first and second pendulum rods which may be attached by spring material ribbons, swing rods, swing rod attachment shafts, a power shaft from the spring motor, and a power shaft to the regulation layer.

In an embodiment, a suspension layer 90 (which may be provided between mounting plates 120 and 130, see FIG. 3 at reference numeral 90, and FIG. 5) serves three major purposes. Namely:

(a) it provides a place to operatively connect a clock movement 28 to the first 24 and second 26 pendulum rods;

(b) it receives power from the spring motor layer 88 and transmits power to the regulation layer 92, and may use a power transmission 122 (details not shown) in such process; and (c) it provides a location to couple the motion of first 24 and second 26 pendulum rods to the swing rods 74 via swing rod links 72, to transmit such motion to the verge 84 and 85.

Regulation Layer 92.

Figure 6:
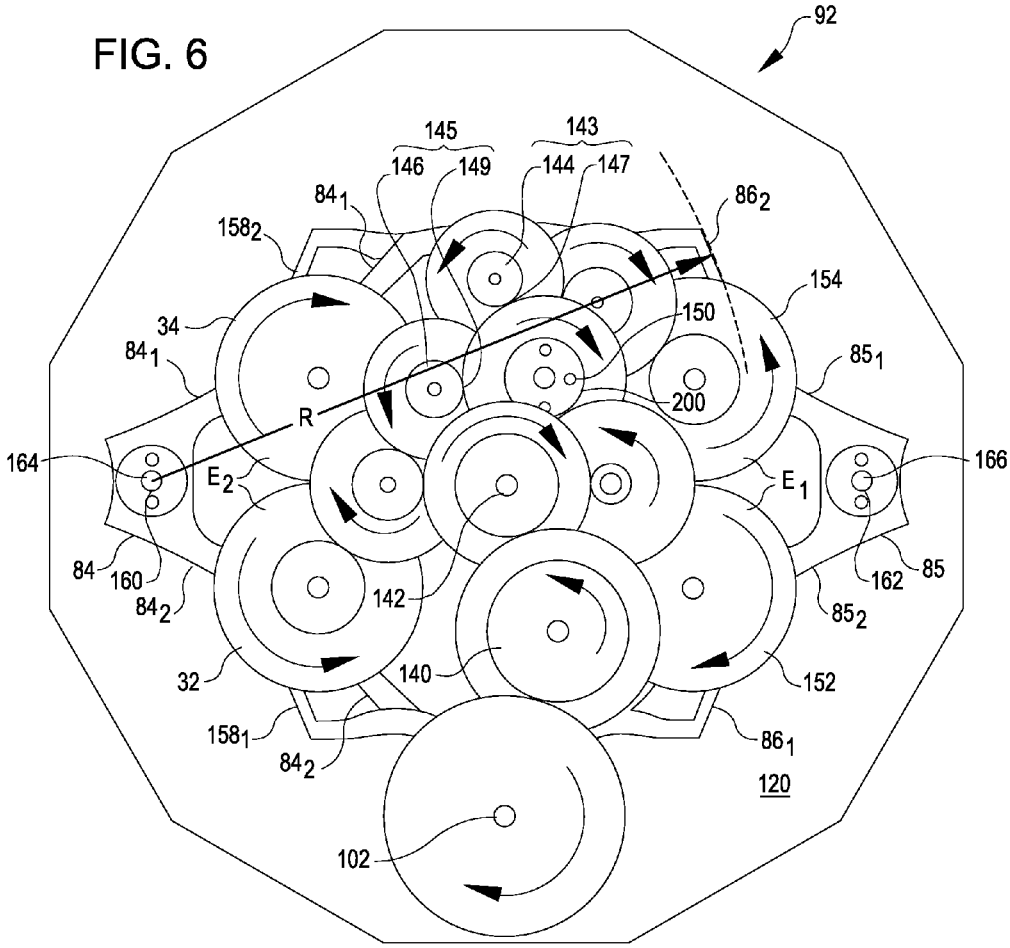
FIG. 6 provides details for an embodiment for a regulation layer in a pendulum-regulated clock, showing the power shaft from the suspension layer, use of concentric hour and minute hand shafts, the use of dual power transmission paths, a differential, meshed escapement wheel pair, the verge arms, the verge pallets, and ratchet.

As seen in FIGS. 3 and 6, in an embodiment, the torque-reduced power from the spring motor 104 passes through power transmission 122 and enters the Regulation Layer 92 at the regulation power shaft 102 (see FIGS. 3, 5, and 6). As better seen in FIG. 6, power may be transferred from regulation power shaft 102 through a series of gears, including a ratchet 140, to a "motion works" mechanism 142 which includes concentric hour hand shaft 98 and minute hand shaft 96. The motion works mechanism 142 may utilize existing technology of gears and fittings to properly synchronize the hour and minute hand shafts and to allow their adjustment, as will be understood by those of skill in the art, and need not be further described herein. The gear train continues and splits into two separate gear train branches 143 and 145, starting at gears 144 and 146 via power transfer at gear mesh points 147 and 149, respectively. A differential 150 may be provided. In this manner, each of the gear train branches 143 and 145 transfers motive force to each of two escapements, shown as $E_1$, which includes first escapement wheel 152 and second escapement wheel 154 which interact with verge 84, and $E_2$ which includes third escapement wheel 32 and fourth escapement wheel 34 which interact with verge 85. The ratio of the dual gear trains is such that the speed of each of the four escapement wheels 32, 34, 152 and 154 translates to one (1) revolution per hour at the motion works mechanism 142. The particular gear ratio which may be utilized depends on the speed of the escapement wheels 32, 34, 152, and 154, which is in turn dependent on escapement design configuration, and the selected pendulum rod length L. Other gear ratios could be utilized for embodiments with pendulum rods having a different length L, or with differently designed escapements.

A prototype embodiment for a clock 20 has been developed that uses two separate escapements, $E_1$ and $E_2$, as described above in relation to FIG. 6. Each of the escapements $E_1$ and $E_2$ include a verge—84 (first verge) and 85 (second verge) respectively, and a meshed pair of escapement wheels (152 and 154 in the case of escapement $E_1$, and 32 and 34 in the case of escapement $E_2$). Each one of first verge 84 and second verge 85 includes a pair of verge arms, $\mathbf{84}_1$ and $\mathbf{84}_2$ in the case of verge 84, and $\mathbf{85}_1$ and $\mathbf{85}_2$ in the case of verge 85. Those just mentioned verge arms end at verge tips or pallets $\mathbf{86}_1$ and $\mathbf{86}_2$ in the case of verge 84, and verge tips or pallets $\mathbf{158}_1$ and $\mathbf{158}_2$ in the case of verge 85. A first verge 84 in escapement $E_1$ may be affixed to a left-hand verge support shaft 160, and a second verge 85 in escapement $E_2$ may be affixed to a right-hand verge support shaft 162. As seen in FIG. 5, the swing rods 74 and 74' are also affixed to these same support shafts, 160 and 162, respectively. In an embodiment, such attachment is provided within the Suspension Layer 90. Accordingly, each verge (84, 85) rotates with the associated verge support shaft (160, 162, respectively) at a pivot point (164, 166) coincident with pendulum swing (e.g., see FIG. 7, reference 170 which shows the direction of verge 85 motion due to pendulum swing, when the pendulum is swinging to the right). However, the clock movement 28, to which are mounted escapement wheels 32 and 34 of second escapement $E_2$ remains near-horizontal (reference line 46 in FIGS. 1A, 1B, and 7), and thus there is motion between the verge arms $\mathbf{85}_1$ and $\mathbf{85}_2$ and the clock movement 28 escapement wheels 32 and 34 (see FIGS. 6 and 7). Likewise, the clock movement 28, to which are mounted escapement wheels 152 and 154 of first escapement $E_1$ remains near-horizontal, and thus there is motion between the verge arms $\mathbf{84}_1$ and $\mathbf{84}_2$ and clock movement 28 escapement wheels 152 and 154 (see FIG. 6).

Figure 7:
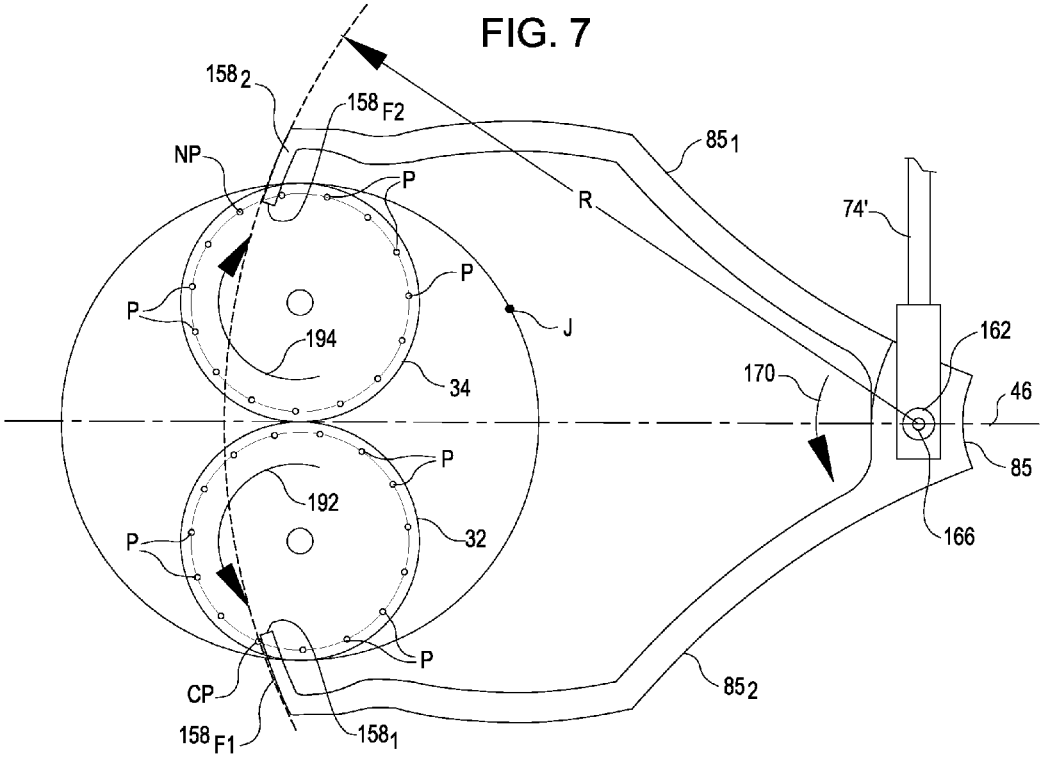
FIG. 7 provides details for an embodiment for a counter-rotating escapement configuration, as at a horizontal position, including a lower escapement wheel peg in deadbeat contact with a verge, a verge tip, a meshed, counter-rotating escapement wheel pair, an upper escapement wheel peg, the upper verge tip, and the verge pivot point.

Counter-rotating Escapement. As seen in FIG. 7, in an embodiment, a counter-rotating escapement $E_2$ may use two synchronized escapement wheels 32 and 34 meshed together such that they rotate in opposite directions. In an embodiment, as also illustrated in FIG. 7, pegs P may be utilized (15 places per wheel as illustrated) for wheel-to-verge contact points between an escapement wheel (e.g. 32 or 34) and the verge at verge tips or pallets $\mathbf{158}_1$ and $\mathbf{156}_2$ in the case of verge 85, and at verge tips or pallets $\mathbf{86}_1$ (lower verge tip) and $\mathbf{86}_2$ (upper verge tip) in the case of verge 84. As illustrated in FIG. 7, a peg which is in deadbeat contact with the verge 85 in escapement $E_2$ is noted as a contact peg CP, and the peg P which will be the next peg to contact verge 85 is noted as next peg NP. Although not illustrated, the geometry and contact mechanism may be provided in the same manner for verge 84 and escapement wheel pair 152 and 154 in escapement $E_1$.

Alternate embodiments may use meshed escapement wheels with teeth rather than pegs. If a prior art common deadbeat escapement $E_D$ is utilized (see FIG. 10), a single, relatively larger escapement wheel 180 may be utilized with verge 182 operating in known fashion with entry pallet 184 and exit pallet 186, rather than with the meshed pair of escapement wheels just described above in connection with escapements $E_1$ and $E_2$.

Operation of Clock.

A method for operation of a clock 20 constructed as described herein is set forth below using escapement $E_2$ as the example. At time=0, with a verge (85) in a horizontal position and moving in a counter-clockwise direction (see FIG. 7, reference number 170), motive force is provided from the springs 106, via the gear train (see FIG. 6). As shown in FIG. 7, this drives the escapement wheels 32 and 34 in the directions shown by reference arrows 192 and 194, respectively. A contact peg CP is in contact with a verge face $\mathbf{158}_{F1}$ which is shaped to follow a radius R with the center point at the verge pivot point 166. This provides "deadbeat" type operation, as would be the case with use of a common deadbeat escapement as noted with respect to FIG. 10. In such operation, the torque at the escapement wheels 32 and 34 does not impart any impulse to the verge 85 during this portion of the swing. Operation continues as the verge 85 rotates slightly (counter-clockwise in the direction of reference arrow 170 in the present example) until the contact peg CP, driven by the torque on the escapement wheel (32, in this example), provides an impulse force to verge 85 via the lower verge tip $\mathbf{158}_1$ thus promoting the current direction of swing.

As escapement $E_2$ rotates counter-clockwise, it eventually loses contact with the lower escapement wheel 32 contact peg CP, at which time the escapement wheels 32 and 34 rotate in the direction shown by reference arrows 192 and 194 until the next peg NP on the upper wheel 34 makes deadbeat contact with the upper verge arm $\mathbf{85}_1$. When the pendulum—e.g. first pendulum rod 24 and second pendulum rod 26—reverses its direction of swing, the verge 85 begins rotating in the direction reverse of that shown by reference arrow 170 in FIG. 7. When that rotation has sufficiently progressed, a peg P on upper wheel 34 will provide an impulse to the upper verge arm $\mathbf{85}_1$ thus further promoting that direction of swing.

The unidirectional rotation of each escapement wheel 32 and 34 provides impulses to promote the oscillating motion of the verge 85. In turn, the period of verge oscillation (governed by pendulum length L) regulates the rotational speed of the escapement wheels 32 and 34. The ratio of the gear train, including the number of pegs P (or teeth, if used) on the escapement wheels 32 and 34, must be matched with the desired pendulum length L. Although not described in detail, operation of the first escapement $E_1$ may be the same, and will be easily understood by those of skill in the art, without the need to repeat the same by additional discussion and separate drawing figure(s).

Split Verge Alternate Embodiment.

In another embodiment, a variation of the Counter-rotating Escapement may be provided, using both sets of escapement wheels (set 32, 34 and set 152, 154 as shown in FIG. 6), but only using one set of verge arms. Any pair of adjacent verge arms as arranged in FIGS. 6 ($84_1$ and $\mathbf{84}_2$, or $\mathbf{85}_1$ and $\mathbf{85}_2$, or $\mathbf{84}_1$ and $\mathbf{85}_1$, or $\mathbf{84}_2$ and $\mathbf{85}_2$) may comprise a complete Counter-rotating Escapement that is different in physical lay-out but functionally identical to the Counter-rotating Escapement set out in FIG. 7.

Dual Escapement with Differential Adjustment.

The basic concept in the use of a Dual Escapement as described above is to simultaneously employ two near-synchronous escapements ($E_1$ and $E_2$) within the clock movement. A gear train that splits into two paths with identical gear ratios as described above in reference to FIG. 6 is used to deliver motive force to both escapements simultaneously. A differential adjustment mechanism 150 may be used to ensure that force is uniformly transferred to both branches of the gear train and subsequently force is delivered uniformly to both escapements $E_1$ and $E_2$. An embodiment may also be provided using a Dual Escapement with Differential Adjustment may also use prior art escapements of common design, or the Counter-rotating Escapement design set forth herein above.

In an embodiment, simultaneous escapements provided by using a Dual Escapement configuration might be completely synchronous in an ideal situation, and thus, no differential adjustment would be necessary. However, the manufacturing tolerances necessary for fully synchronous operation are rather precise, and thus may not be implemented as a practical matter. On the other hand, when a single escapement is used, a Differential Adjustment, as just described, is not necessary.

Benefits of Dual Escapement with Differential Adjustment.

For a pendulum-regulated clock as described herein, where there are two pendulum rods (24, 26), a Dual Escapement ($E_1$ and $E_2$) with differential 150 adjustment configuration ensures that torques and forces compelling pendulum operation are symmetric. In other words, each of first 24 and second 26 pendulum rods is driven by a force equal to that applied to the other pendulum rod. In an embodiment, such uniformity and symmetry promotes isochronous operation. Also, though less important but applicable generally to escapements, a configuration Dual Escapement with Differential Adjustment cuts in half the forces transmitted through each one of the escapements $E_1$ and $E_2$. Consequently, such an embodiment may reduce wear and increase escapement operational life.

Prototype Embodiment.

An embodiment for a pendulum-regulated clock 20 has been provided in a prototype, as illustrated in FIGS. 11 and 12. In that prototype embodiment, the lay-out and interaction of two Counter-rotating Escapement mechanisms is as shown in FIG. 6. Thus, the differential adjustment mechanism 150 that ensures equal transfer for force to each escapement is provided in the manner shown in FIGS. 8 & 9.

Operation of Differential Adjustment.

Figure 8:
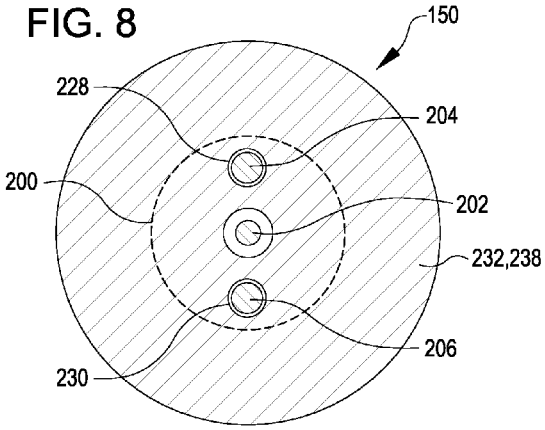
FIG. 8 is a front view of an embodiment for a differential mechanism providing differential adjustment for a dual escapement configuration, showing a rotation shaft, a drive gear which rotates with the shaft, the driven gears, pivot pins that transfer force from the drive gear to the driven gears, and attach pins that anchor pivot pins to the drive gear.
Figure 9:
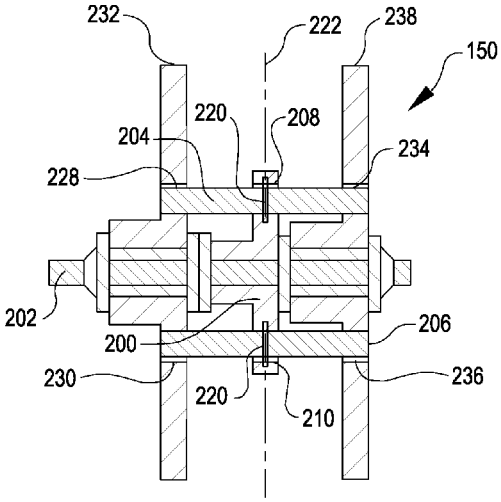
FIG. 9 is a side cross-sectional view of the embodiment just shown in FIG. 8 above for differential mechanism, showing a rotation shaft, a drive gear which rotates with the shaft, the driven gears, pivot pins that transfer force from the drive gear to the driven gears, and attach pins that anchor pivot pins to the drive gear.

For context, the differential adjustment mechanism 150, shown in FIG. 6 and in detail in FIGS. 8 and 9, is positioned within the gear train anywhere between the single minute hand shaft 96 and the two pairs of meshed escapement wheels (32, 34, and 152, 154). Operation of the differential adjustment mechanism 150 begins at the differential adjustment mechanism 150 pinion gear 200 (see FIG. 6 and FIGS. 8 and 9). The pinion gear 200 is driven by the previously-described gear train with power from the Spring Motor 88. This pinion gear 200 is attached to a shaft 202 which is free to rotate within the clock movement 28. As the pinion gear 200 rotates, pivot pins 204 and 206 (FIGS. 8 & 9) move with it. The pivot pins are installed through holes defined by sidewalls 208 and 210 in the pinion gear 200 that are slightly larger than the pivot pins 204 and 206, and which may allow some relative motion between the pinion gear and the pivot pins. Further, the pivot pins 204 and 206 are secured to the pinion gear 200 by attach pins 220 which allow the pivot pins 204 and 206 to rotate slightly around the attach pin axis 222.

The pivot pins 204 and 206 are installed such that they extend into holes defined by sidewalls 228 and 230 within the differential output gear 232, and into holes defined by sidewalls 234 and 236 in output gear 238. The holes defined by sidewalls 228 and 230 in gear 232, any by sidewalls 234 and 236 in output gear 238 are also slightly larger than the pivot pins 204 and 206 so that some relative motion is allowed. As the pivot pins 204 and 206 travel radially with the pinion gear, one end or the other will contact a differential output gear 232 or 238. This contact force causes the pivot pins 206 and 208 to rotate slightly until the other side of the pin 206 or 208 comes in contact with the other differential output gear, which may be output gear 232 or output gear 238. At this point in the operation, the pivot pins 204 and 206 provide uniform force transmission from the pinion gear 200 to both differential output gears 232 and 238. However, uniform motion of the output gears 232 and 238 is not enforced. This allows one output gear (232 or 238) to advance slightly more, or sooner, than the other. In turn, this allows the simultaneous and uniform engagement of both escapements $E_1$ and $E_2$ (via the dual gear train paths illustrated in FIG. 6) regardless of minor differences in geometry caused by inevitable manufacturing imperfections.

Use of Prototype Clock.

A pendulum-regulated clock 20 as described herein may be used in a manner similar to any mechanically-driven, pendulum-regulated clock. However, in the prototype embodiment depicted herein, the clock 20 must be stopped in order to be wound. This is required about once a week. The clock 20 can then be re-started with a gentle push. Time setting is accomplished by simply moving the minute and hour hands until the desired time is reached, as is with prior art motion works (the arrangement that keeps concentric hour and minute hands properly synchronized). Adjusting the clock pendulum frequency is effected by any one or more of several techniques, including lengthening or shortening the length L of pendulum rods (24, 26), adjusting either up or down the upper attach point of the pendulum rods (as illustrated in FIG. 2 and described herein above), or adjusting either up or down a weight W affixed to the clock movement, as will be understood by those of skill in the art.

In the foregoing description, numerous details have been set forth in order to provide a thorough understanding of the disclosed exemplary embodiments for providing pendulum-regulated clocks. However, certain of the described details may not be required in order to provide useful embodiments, or to practice selected or other disclosed embodiments. Further, the description may include, for descriptive purposes, various relative terms such as surface, adjacent, proximity, near, on, onto, and the like. Such usage should not be construed as limiting. Terms that are relative only to a point of reference are not meant to be interpreted as absolute limitations, but are instead included in the foregoing description to facilitate understanding of the various aspects of the disclosed embodiments. Various items in the apparatus and in the method(s) described herein may have been described as multiple discrete items, in turn, in a manner that is most helpful in understanding such aspects and details. However, the order of description should not be construed as to imply that such items or sequence of operations are necessarily order dependent, or that it is imperative to fully complete one step before starting another. For example, the choice of the type of escapement used may depend on a variety of cost and use factors, and such decisions may be different as regards installation particulars amongst various clock builders. Further, certain details of installation may not need to be performed in the precise or exact order of presentation herein. And, in different embodiments, one or more items may be performed simultaneously, or eliminated in part or in whole while other items may be added. Also, the reader will note that the phrase "an embodiment" has been used repeatedly. This phrase generally does not refer to the same embodiment; however, it may. Finally, the terms "comprising", "having" and "including" should be considered synonymous, unless the context dictates otherwise.

Various aspects and embodiments described and claimed herein may be modified from those shown without materially departing from the novel teachings and advantages provided by this invention, and may be embodied in other specific forms without departing from the spirit or essential characteristics thereof. Embodiments presented herein are to be considered in all respects as illustrative and not restrictive or limiting. This disclosure is intended to cover methods and apparatus described herein, and not only structural equivalents thereof, but also equivalent structures. Modifications and variations are possible in light of the above teachings. Therefore, the protection afforded to this invention should be limited only by the claims set forth herein, and the legal equivalents thereof.

The invention claimed is:

1. A clock, comprising:

a first pendulum rod and a second pendulum rod, said first pendulum rod and said second pendulum rod arranged in near-parallel position;

a pendulum bob suspended from said first pendulum rod and from said second pendulum rod;

a clock movement, said clock movement provided as a part of, or within said pendulum bob, said clock movement comprising one or more escapement mechanisms;

said first pendulum rod, and said second pendulum rod operatively connected for swinging motion powered by impulse energy from movement of said first pendulum rod and or said second pendulum rod via said one or more escapement mechanisms; and wherein relative angular motion between said near-horizontal motion of said clock movement, and (a) said first pendulum rod, or (b) said second pendulum rod, or (c) both, provides regulation of said one or more escapement mechanisms.

2. The clock as set forth in claim 1, wherein said clock movement is configured for near-horizontal movement during said swinging motion.

3. The clock as set forth in claim 1, wherein said clock movement is configured for precisely horizontal movement during said swinging motion.

4. The clock as set forth in claim 1, further comprising adjustment mechanisms at either end of each said first and said second pendulum rod, said adjustment mechanisms responsive to said near-parallel position of said first pendulum rod and said second pendulum rod.

5. A clock, comprising:

a first pendulum rod and a second pendulum rod, said first pendulum rod and said second pendulum rod arranged in precisely parallel position;

a pendulum bob suspended from said first pendulum rod and from said second pendulum rod;

a clock movement, said clock movement provided as a part of, or within said pendulum bob, said clock movement comprising one or more escapement mechanisms;

said first pendulum rod, and said second pendulum rod operatively connected for swinging motion powered by impulse energy from movement of said first pendulum rod and or said second pendulum rod via said one or more escapement mechanisms; and wherein relative angular motion between said near-horizontal motion of said clock movement, and (a) said first pendulum rod, or (b) said second pendulum rod, or (c) both, provides regulation of said one or more escapement mechanisms.

6. The clock as set forth in claim 5, wherein said clock movement is configured for near-horizontal movement during said swinging motion.

7. The clock as set forth in claim 5, wherein said clock movement is configured for precisely horizontal movement during said swinging motion.

8. A clock, comprising:

a first pendulum rod and a second pendulum rod, said first pendulum rod and said second pendulum rod arranged in near-parallel position;

a pendulum bob suspended from said first pendulum rod and from said second pendulum rod;

a clock movement, said clock movement provided as a part of, or within said pendulum bob, said clock movement comprising two escapement mechanisms;

said first pendulum rod, and said second pendulum rod operatively connected for swinging motion powered by impulse energy from movement of said first pendulum rod and said second pendulum rod via said two escapement mechanisms; and wherein relative angular motion between said near-horizontal motion of said clock movement, and (a) said first pendulum rod, or (b) said second pendulum rod, or (c) both, provides regulation of said two escapement mechanisms.

9. The clock as set forth in claim 8, wherein said clock movement is configured for near-horizontal movement during said swinging motion.

10. The clock as set forth in claim 8, further comprising adjustment mechanisms at either end of each said first and said second pendulum rod, said adjustment mechanisms responsive to said near-parallel position of said first pendulum rod and said second pendulum rod.

11. The clock as set forth in claim 8, wherein each of said two escapement mechanisms comprise two counter-rotating escapement wheels.

12. The clock as set forth in claim 11, wherein each of said two escapement mechanisms comprise a verge having a pair of verge pallets, and wherein each of said counter-rotating escapement wheels comprise a plurality of pegs, and wherein said verge pallets and said plurality of pegs interact during operation to regulate said clock.

* * * * *

UNITED STATES PATENT AND TRADEMARK OFFICE

CERTIFICATE OF CORRECTION

PATENT NO. : 8,876,370 B1
APPLICATION NO. : 14/201135
DATED : November 4, 2014
INVENTOR(S) : Mark E. Pampe It is certified that error appears in the above-identified patent and that said Letters Patent is hereby corrected as shown below:

In the Specification

Column 1, Line 66, after the word ""swinger", delete "clock's" and substitute therefore --clocks--.

Column 2, Line 34, after the words "with two", delete ".".

Column 2, Line 38, after the words "showing two", delete ".".

Column 6, Line 33, after the words "horizontal line 42", delete ")".

Column 7, Line 22, after the words "with shaft 96", insert --.--.

Column 9, Line 20, after the words "or pallets 158, and", delete "$156_2$" and substitute therefore --$158_2$--.

Column 9, Line 42, after the word "reference", delete "number" and substitute therefore --arrow--.

Signed and Sealed this
Second Day of January, 2018

Joseph Matal

Joseph Matal
*Performing the Functions and Duties of the*
*Under Secretary of Commerce for Intellectual Property and*
*Director of the United States Patent and Trademark Office*